United States Patent [19]

Kiehl et al.

[11] 3,970,182

[45] July 20, 1976

[54] MULTIPLE COIN PARKING METER

[75] Inventors: William C. Kiehl; Thomas F. Moore, both of Russellville; Jimmie C. Teague, Dover, all of Ark.

[73] Assignee: Rockwell International Corporation, Pittsburgh, Pa.

[22] Filed: Oct. 22, 1975

[21] Appl. No.: 624,673

Related U.S. Application Data

[63] Continuation of Ser. No. 540,129, Jan. 10, 1975, abandoned.

[52] U.S. Cl. ..... 194/84

[51] Int. Cl.[2] ..... G07F 5/00

[58] Field of Search ..... 194/61, 84, DIG. 22, 194/DIG. 4, 9 T

[56] References Cited

UNITED STATES PATENTS 3,506,102 4/1970 Mathison et al. ..... 194/84

*Primary Examiner*—Stanley H. Tollberg

[57] ABSTRACT

A parking meter for handling coins of different denominations has a single entrance slot for admitting coins into the interior of the meter where they are received in a pocket on a coin carrier. A first cam surface cooperated with the coin on initial movement of the coin carrier to position the coin in the pocket to cooperate with the appropriate one in accordance with the coin denomination of a plurality of time setting cam surfaces which cooperate with the coin to set time on the meter in accordance with the coin denomination as the carrier is moved through the remainder of its time setting cycle.

12 Claims, 14 Drawing Figures

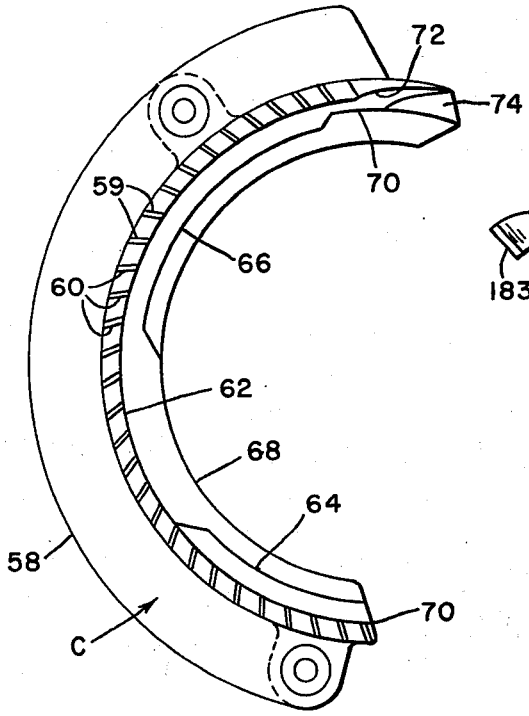
FIG. 4.
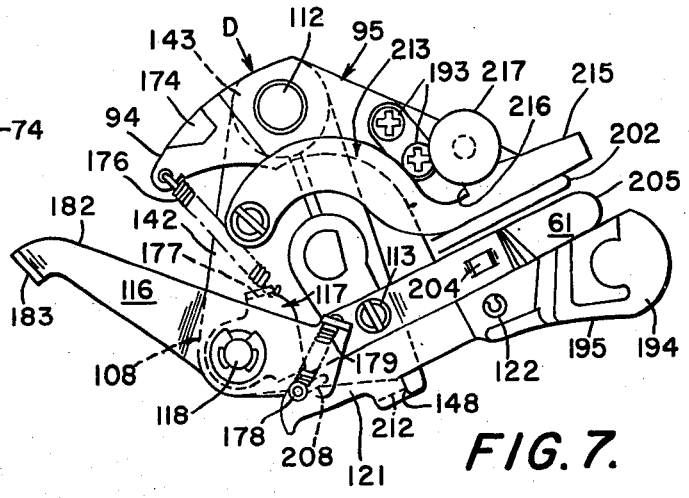
FIG. 7.
FIG. 5.
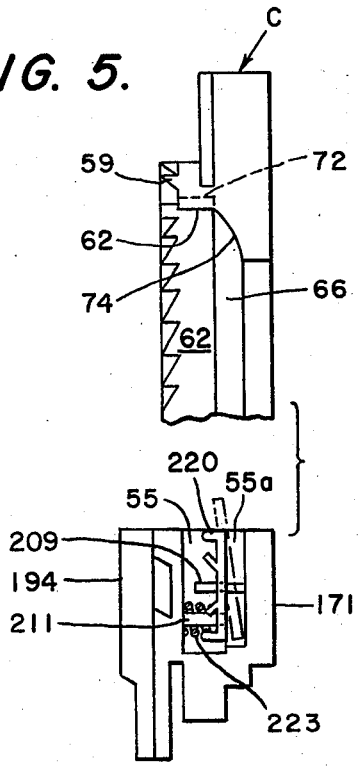
FIG. 12.
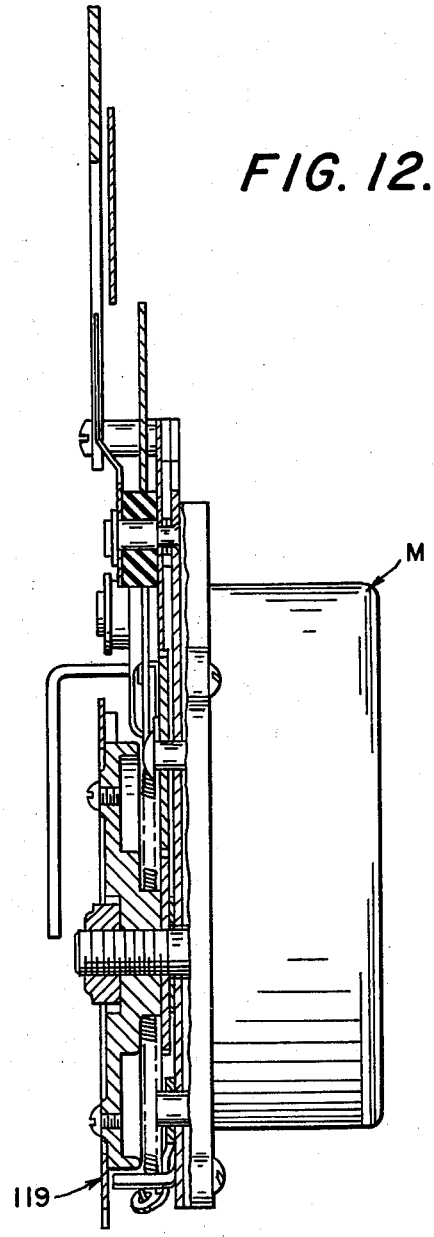

MULTIPLE COIN PARKING METER

This is a continuation of application Ser. No. 540,129, filed Jan. 10, 1975. now abandoned.

BACKGROUND OF THE INVENTION

Multiple coin parking meters as heretofore constructed, particularly meters of the manually operated type have employed multiple openings in the meter housing to accommodate each coin denomination. A typical example of such prior art meters is shown in U.S. Pat. No. 3,506,102 of which the present invention is an improvement. Usually the multiple openings are aligned respectively with multiple pockets in the coin carrier which in turn are aligned respectively with multiple cam surfaces each cam surface being of a proper length to cooperate with one coin denomination to cause the appropriate amount of time to be registered for its respective denomination. The problem with such prior art parking meters is that if a coin of the wrong denomination is inserted into one of the slots, for example if a dime is inserted into the nickel slot in the housing, the coin may be cycled through the meter without registering any time and it will not be returned to the person inserting the coin. This problem of course gives rise to any complaints from users of such parking meters. The present invention solves this problem by providing only a single coin entrance slot in the meter housing and means within the meter itself whereby the coin is positioned in accordance with its denomination opposite the appropriate time setting cam surface within the meter.

SUMMARY OF THE INVENTION

Accordingly it is an objective of the present invention to provide a parking meter in which only one coin entrance slot is necessary. A further object of the present invention is to provide a parking meter according to the preceding objective in which the coin is received into a pocket in the coin carrier and upon initial movement of the coin carrier is automatically positioned in accordance with the coin denomination opposite the proper one of several time setting cam surfaces. A still further object is to provide a parking meter in accordance with the preceding objectives and in which the coin is resiliently biased to an initial position within the pocket and coins of a certain denomination are cammed upon initial movement of the coin carrier against the bias to a position opposite the appropriate one of several time setting cam surfaces.

BRIEF DESCRIPTION OF THE DRAWINGS

FIG. 4 is a front elevational view of the coin cam of FIG. 3 on an enlarged scale;

FIG. 5 is a fragmented drawing showing the coin cam member and the coin pocket of the coin carrier in aligned cooperative position but slightly removed from each other for the sake of clarity;

FIG. 7 is an enlarged front elevational view of the coin drive mechanism of FIG. 3;

FIG. 12 is a vertical sectional view on line 12—12 of FIG. 11 looking in the direction of the arrows.

DESCRIPTION OF THE PREFERRED EMBODIMENT

Figure 1:
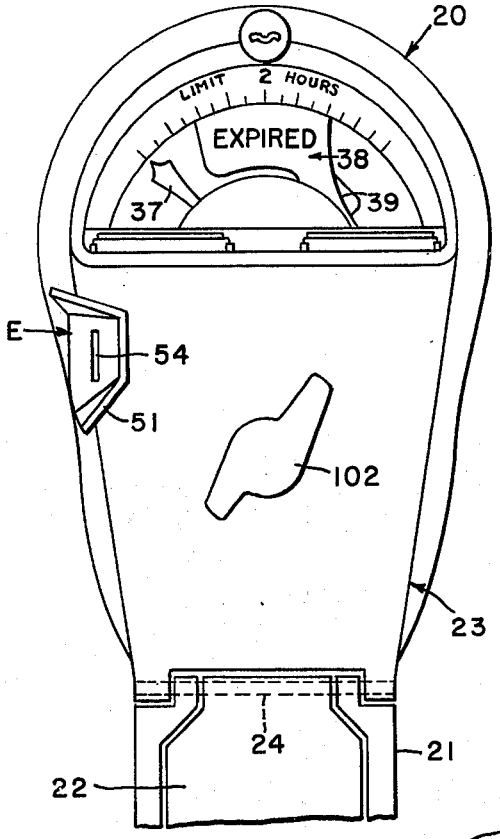
FIG. 1 is a front elevational view of a parking meter made in accordance with the present invention as viewed from the face of the door casing.

The meter of the present invention is an improvement to the meter disclosed in U.S. Pat. No. 3,506,102 and much of the mechanism of the meter shown in that patent is utilized in the meter of the present invention. With continued reference to the accompanying drawings, the meter 20 of the present invention comprises a conventional two-part meter housing made up of a base member 21 defining a coin box (not shown) and adapted to be mounted in the conventional manner on a support post or the like (not shown) and a door casing 23 hingedly mounted upon base 21 by means of the opposite ends of a hinge pin 24 in the manner as described in U.S. Pat. No. 3,506,102.

Figure 3:
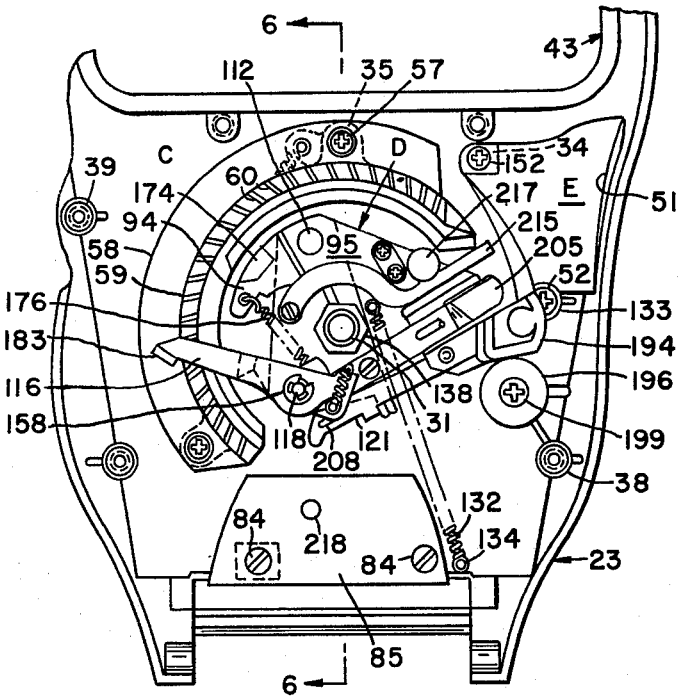
FIG. 3 is a fragmental elevational view of the inside face of the door casing of FIG. 2 with a coin drive mechanism and coin cam in operative correlation therein.
Figure 6:
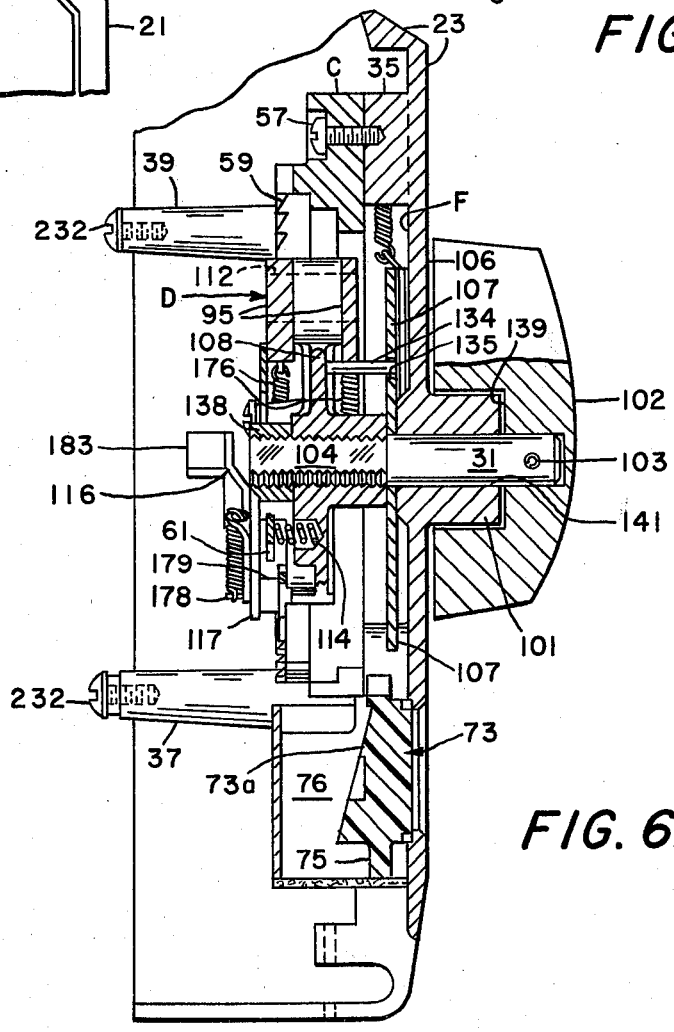
FIG. 6 is an enlarged fragmental vertical sectional view taken along line 6—6 of FIG. 3 looking in the direction of the arrows in FIG. 3.

As will be clear from FIGS. 3, 6 and 7 the coin drive mechanism D is non-rotatably mounted on a shaft 31 centrally journalled in the wall forming face F of door casing 23 for rotation in spaced relation to face F which is provided at angularly spaced points around shaft 31 with suitable upstanding bosses 33 to 36 adapted to mount a coin entrance member E and a coin cam C, and upstanding bosses 37 through 39 for mounting time module or meter clock and indicator flag unit M, including a clock movement not shown, expired time flag and its operating linkage 41, and violation flag and its operating mechanism 42.

Figure 2:
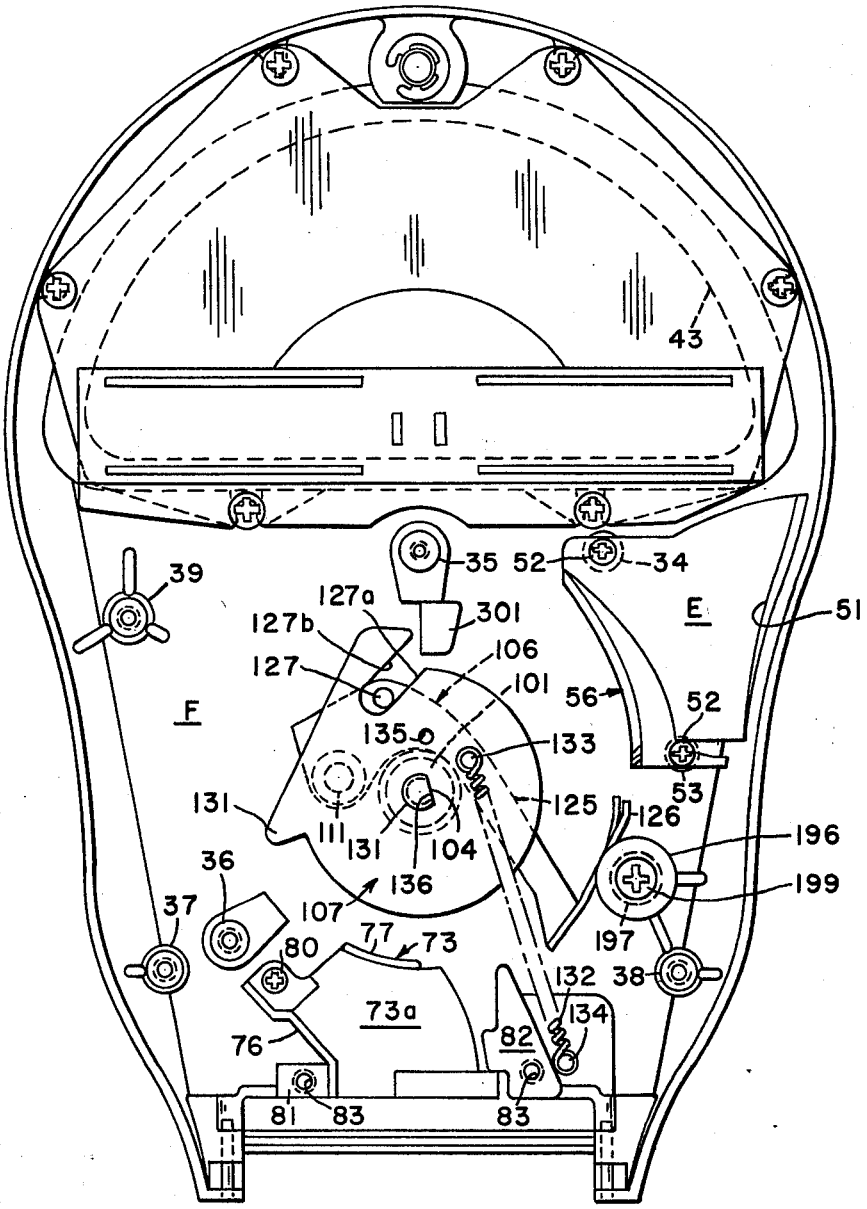
FIG. 2 is an enlarged elevational view looking into the inside face of the door casing showing the details of construction for mounting a meter mechanism.

As best seen in FIGS. 1 through 3, door casing 23 adjacent and below one end of window opening 43 is apertured at 51 to receive coin entrance member E, preferably of hardened plastic, fixed to casing 23 by securing screws 52 freely passed through screw passages (not shown) suitably formed at the inner corners of member E and threaded into tapped bosses 33 and 34 formed on casing 23. Member E comprises a laminar block of plastic having coin slot 54 (FIG. 1) formed therein and adapted in the present embodiment to receive a dime, a nickel and a quarter. The entrance member E is preferably sealed to the walls of aperture 51 and serves to pass the inserted coins from the exposed face of member E through the opposite face 56 (FIGS. 2 and 3) from which the coins pass by gravity into the coin pocket formed in the coin carrier of coin drive mechanism D, in a manner to be presently described in detail.

THE COIN CAM

Coin cam C, shown in FIGS. 3 to 6 is of generally arcuate configuration and about 180° in length, and is fixedly mounted to casing 23 by securing screws 57 passing freely through screw passages in flange 58 formed on the peripheral face of coin cam C and located therealong in position to align with tapped bosses 35 and 36 so screws 57 can be threaded home into bosses 35 and 36 to draw coin cam C down against bosses 35 and 36 leaving a space between coin cam C and face F of casing 23 below the portion of coin cam C lying between bosses 35 and 36. Referring for the moment to FIG. 4, the outer peripheral marginal portion of the upper face of coin cam C is provided with integral upstanding ratchet teeth 59 disposed along an arcuate path concentric with rotational axis of coin drive mechanism D provided by shaft 31 journalled in casing 23. Ratchet teeth 59 are formed at their counterclockwise disposed ends with right angularly upstanding faces 60 and their opposite faces slope in a clockwise direction from the upper ends of faces 60 to the upper face of coin cam C immediately adjacent the lower ends of the adjacent clockwise disposed tooth faces 60. Teeth 59 serve as ratchet teeth for cooperation with an anti-back pawl (FIG. 7) of coin drive mechanism D to be hereinafter described in detail.

In the disclosed embodiment of the invention and purely as an example of an operative structure the operable dimensions dictated by the diameter of the coins to be handled and the size of the coin drive mechanism D, a dime, nickel, quarter in the illustrated meter, coin cam C radially inwardly from ratchet teeth 59 is provided with an arcuate cam wall 62 normal to the plane of cam C which, when coin cam C is assembled on door casing 23 as described above, will be concentrically related to the rotational axis of shaft 31 of coin drive mechanism D. Cam wall or surface 62 merges with cam surface 64 which is concentric with and in the same plane as wall 62 but spaced radially inwardly with respect to wall 62 as best shown in FIG. 4. Cam 72 is in the same plane and concentric with wall 62 but is spaced radially outwardly therefrom and merges with wall 62 as shown in FIG. 4. Spaced radially inward from cam wall 62 is cam wall 66 which is concentric to but axially spaced from walls 62 and 64 with respect to the axis of curvature thereof which is also the axis of rotation of shaft 31 (FIGS. 3 and 6). Cam wall 66 merges with inner cam wall 68 which is concentric to walls 62, 64 and 66 and is spaced radially inward from wall 66. Cam wall 70 is in the same plane and concentric with wall 66 and is spaced radially outwardly of wall 66 but radially inwardly from wall 72. Thus cam walls 62, 64 and 72 are all in the same plane and walls 66, 68 and 70 are in the same plane which is axially spaced from the plane of walls 62, 64, and 72. Cam surface 74 as shown in FIGS. 4 and 5 is a transition surface extending axially from the plane of wall 66 to the plane of wall 62. Circumferentially cam surface 74 extends from the beginning of cam C to a point short of the point where wall 72 merges with wall 62. The arcuate length of walls 62, 64 and 68 are proportioned to cause the meter to register time proportioned respectively to a quarter, nickel and a dime.

COIN DRIVE MECHANISM

As best seen in FIG. 6, one end of shaft 31 protrudes from the outer face of casing 23 through an integrally formed journal boss 101 and mounts an actuating knob 102 fixed to shaft 31 by pin 103. Its opposite end is threaded and formed with a longitudinally extending flat 104 extending inwardly from the shaft end face to the point of entry of shaft 31 into boss 101.

A lay in shutter lever 106 (FIGS. 2 and 6) is pivotally mounted on face F of casing 23 through an upstanding pivot boss 111 integrally formed on face F of casing 23. Radially outwardly disposed from journal boss 101, a cam disc 107 is mounted on shaft 31 for rotation therewith in immediate juxtaposition above lay in shutter lever 106 (FIGS. 2 and 6), and coin drive mechanism D is mounted through its pillar assembly 108 (FIGS. 3 and 7 to 9) on shaft 31 for rotation therewith and with cam disc 107, and includes coin carrier assembly 95 (FIGS. 3, 7, 10*a*, 10*b* and 10*c*) pivoted to hinge pillar assembly 108 at 112 (FIGS. 3 and 7), anti-backup pawl 61 (FIGS. 3 and 7) loosely fixed by screw 113 to hinge pillar assembly 103 for limited rising and falling movement under influence of compression spring 114 (FIG. 6) seated in a spring recess 115 (FIG. 8) formed in hinge pillar assembly 108. A pick up lever assembly 116 and cam lever assembly 117 (FIGS. 3 and 7) pivoted at 118 to hinge pillar assembly 108 are adapted to respectively actuate the rack plate 119 (FIG. 11) and push lever 121 (FIG. 7) pivoted by roll pin 122 to coin carrier assembly 95.

Figure 8:
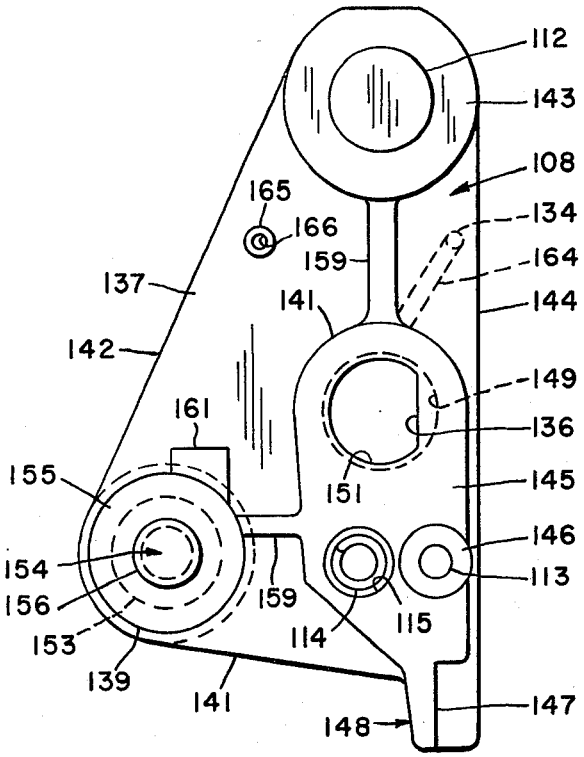
FIGS. 8 and 9 are respectively a front elevational view and a right side view enlarged for clarity of the hinge pillar assembly of the coin drive mechanism of FIG. 7.

Referring for the moment to FIGS. 2 and 3, lay in shutter lever 106 comprises an arm 125 partially encircling journal boss 101 and formed at its free end with an upstanding arcuate blade portion or shutter 126 adapted to be moved from its normal rest position (shown in FIGS. 2 and 3), counterclockwise to a position blocking the coin slot of coin entrance member E during initial time setting movement of knob 102 and shaft 31 through camming engagement of cam pin 127 fixed in the body portion of lay in shutter lever 106 and the opposing camming surface 127*a* of cam disk 107. Disk 107, as shown in FIG. 2, is formed counterclockwise beyond camming surface 127*a* with a peripherally outwardly directed stop finger 131 and is normally biased in a clockwise direction to its normal home position (see FIG. 2) by tension spring 132 connected to upstanding spring post 133 fixed to disk 107 and upstanding spring post 134 integrally formed on face F of casing 23. Spring 32 also serves to bias coin drive mechanism D, shaft 31, knob 102, and cam disk 107 as a unit to their normal home position (see FIGS. 1 and 3) due to the interengagement between pin 134 (see FIG. 6) integrally formed on the under face of hinge pillar assembly 108 with a through opening 135 provided in disk 107 and the interengagement of flats 136 formed in the shaft bores of disk 107 and hinge pillar assembly 108 with the longitudinally extending flat 104 provided on shaft 31 (FIGS. 2 and 8). As the coin drive mechanism D and disk 107 are returned to their home position under the influence of spring 132, pin 127 is engaged by cam surface 127*b* to capture pin 127 in the slot in disk 107 formed between cam surface 127*a* and 127*b* so that continued rotation of disk 107 toward its home position will cause shutter lever 106 to rotate about pivot boss 111 to its position shown in FIG. 2. A nut 138 threaded on the inner end of shaft 31 fixes hinge pillar assembly 108 and disk 107 in end abutting engagement to each other and disk 107 and end wall 139 of the recess 141 of knob 102 in rotational bearing contact with the respective oppositely facing end faces of journal boss 101 (see FIG. 6).

Figure 9:
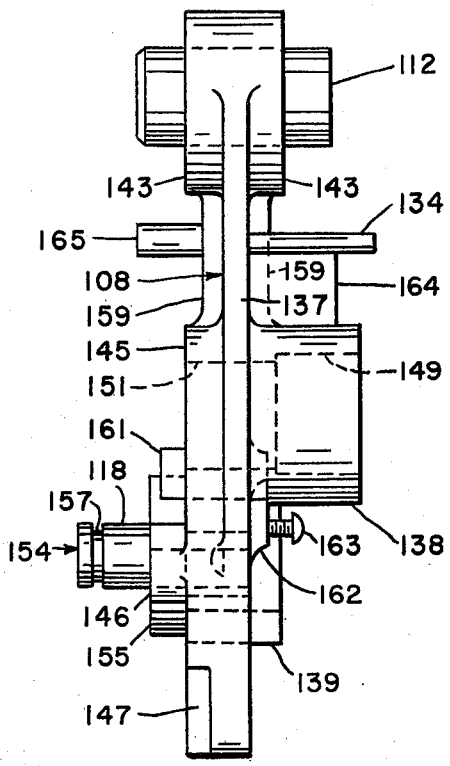

The details of hinge pillar assembly 108 are shown in FIGS. 8 and 9. As there shown assembly 108 comprises a generally triangular body 137 having a mounting boss 138 extending from its bottom face, oppositely extending upstanding coaxial bosses 139 on its opposite faces adjacent the intersection of edges 141 and 142, oppositely extending upstanding coaxial bosses 143 on its opposite faces adjacent the intersection of edges 142 and 144 and an upstanding land 145 of substantial width formed on its upper face extending along the portion of edge 144 opposite bosses 139 and terminating approximately midway of the length of edge 144 in an arcuate end wall formed on a radius equal to that of boss 138 with the axial center of boss 138 as a center. The opposite edges of land 145 are tangent to the diametrically opposite end of the arcuate end wall to a point substantially opposite the horizontal centerline of bosses 139 as seen in FIG. 8. The edge of land 145 adjacent edge 144 intersects an upstanding annular boss 146 having a tapped blind bore receiving screw 113 of antiback up pawl 61 previously described. Recess 115 for spring 114 previously described is formed in land 145 immediately adjacent boss 146 and the sides of land 145 beyond recess 115 and boss 146 are respectively inclined and inwardly recessed to define a narrow upstanding rib-like formation 147 on body 137 beyond the point of intersection of edge 141 to form stop shoulder 148 for push lever 121 in a manner to be presently pointed out. Boss 138 and the axially aligned portions of body 137 and land 145 are apertured respectively at 149 and 151 to freely pass and snugly receive the flattened portion of shaft 31 while bosses 143 and the aligned portion of body 137 is provided with a through bore to fixedly mount a pivot pin 112 the opposite ends of which protrude to form respective pivots for the coin carrier and slot assembly 95 to be presently described in detail. Bosses 139 and the aligned portion of body 137 are provided with a through bore to fixedly mount the stem 153 of a step pivot having an annular spacer body 155 and an upstanding pivot portion 118 annularly recessed at 157 to receive an E-ring 158 (FIG. 3). Pivot portion 118 forms a common pivot for pick up lever assembly 116 and cam lever 117. Respective strengthening ribs 159 extend along the opposite faces of body 137 between boss 143 and boss 138, land 145 and boss 143, and land 145 and boss 139. A radially outwardly disposed upstanding projection 161 is formed on the upper face of body 137 adjacent boss 139 to form a home stop for cam lever 117. A shallow land 162 extends along the under face of body 137 between bosses 138 and 139 and is provided with a blind aperture (not shown) into which a spring post 163 is pressfitted for a purpose to be presently pointed out. Pin 134 is formed on the under face of body 137 adjacent edge 144 and is integrally connected to boss 138 by a deep rib-like reinforcing web 164. A post 165 having a blind tapped bore 166 is formed in the upper face of body 137 for a purpose to be hereinafter pointed out.

Figure 10A:
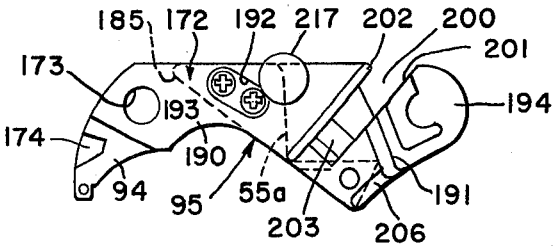
FIG. 10*a* is a front elevational view of the coin carrier of the coin drive mechanism of FIG. 7 with certain parts removed.
Figure 10B:
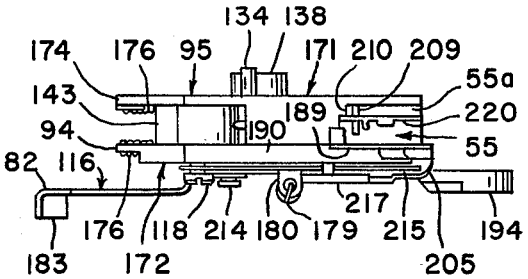
FIG. 10*b* is a top plan view of the coin drive mechanism of FIG. 7.
Figure 10C:
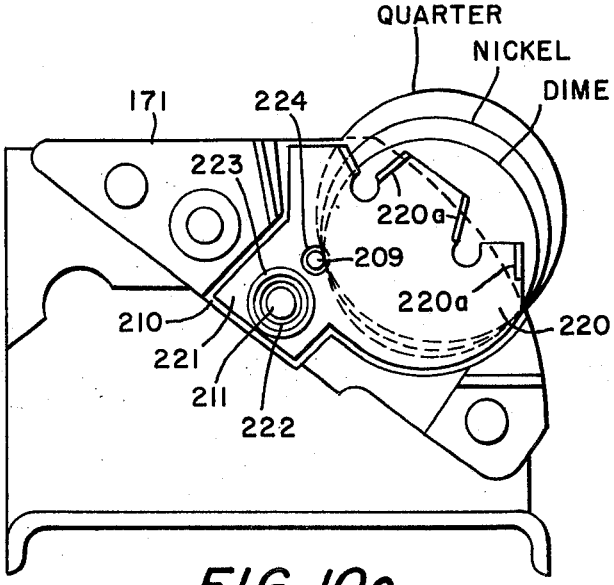
FIG. 10*c* is an enlarged view of that section of the coin carrier in which is formed the coin pocket showing the position of the coins of various denominations when received in the pocket and showing in overlaying relationship to the coins the resiliently biased plate member.
Figure 11:
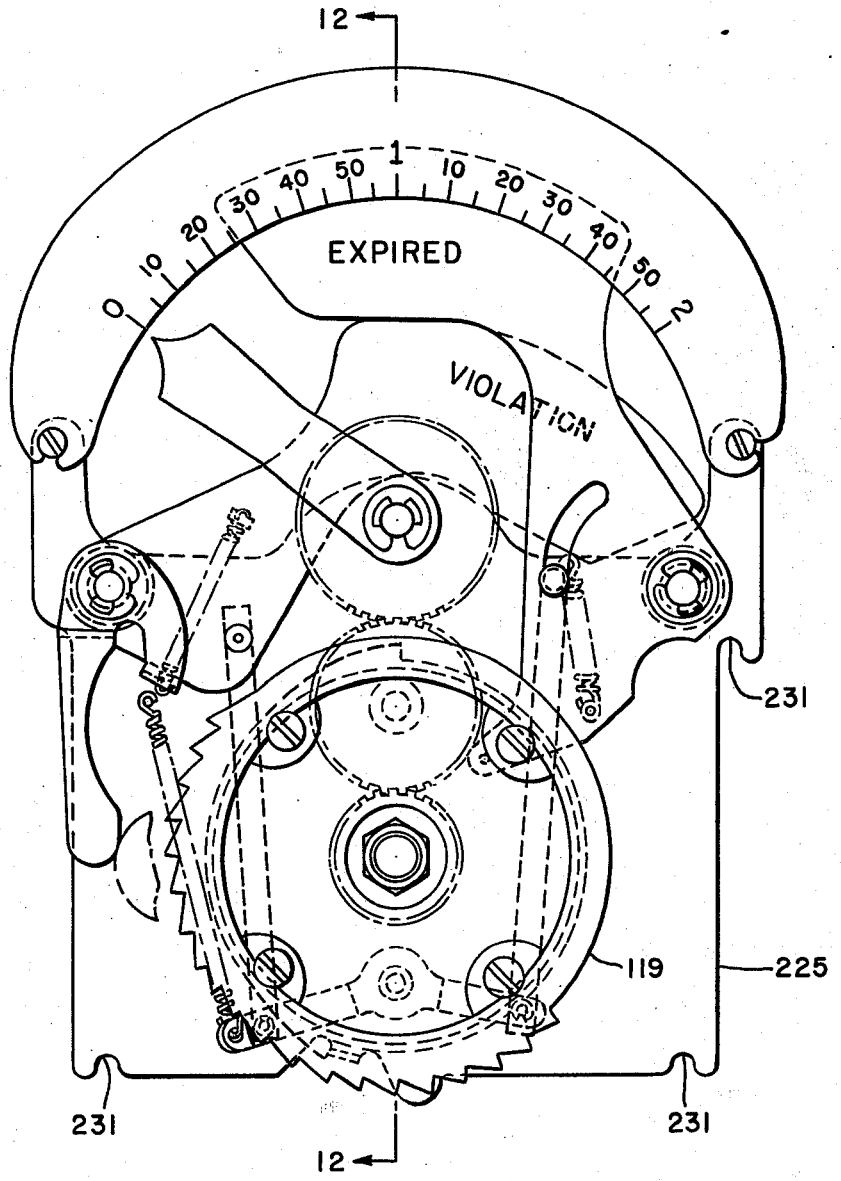
FIG. 11 is a front elevational view of a meter clock and indicator flag unit employed in the parking meter of FIG. 1.

The details of coin carrier assembly 95 are shown in FIGS. 10a, 10b and 10c and when associated with the hinge pillar assembly 108 just described from coin drive mechanism D. As there shown coin carrier and slot assembly 95 is fabricated from a main body or coin carrier bottom member 171, and cover or coin carrier top member 172 each formed with a journal bore 173. Bottom member 171 is provided with a spring arm 174 while top member 172 has integrally formed thereon spring arm 94 in spaced overlying relation to springarm 174. Spring arms 94 and 174 provide anchors to which the ends of biasing springs 176 (FIG. 7) are connected, their opposite ends being respectively connected to spring anchor post 163 (FIG. 9) fixed to hinge pillar assembly 108 and downturned stop arm 177 of cam lever assembly 117. Biasing springs 176 bias coin carrier and slot assembly 95 counterclockwise around its pivot formed by one end of pivot pin 112 while biasing spring 176 connected to finger 94 of coin carrier top member 172 also biases cam lever assembly 117 counterclockwise around pivot portion 118 to normally seat stop arm 177 against the opposing face of stop 161 formed on hinge pillar assembly 108. The oppositely directed arm of cam lever assembly 117 carries spring anchor and stop post 178 connected to drive spring 179 connected at its other end to spring anchor tab 180 formed at one side of the free end of short drive arm 181 of pick up lever assembly 116 to bias pick up lever assembly 116 (FIG. 7) clockwise around the common pivot portion 118 carrying cam lever assembly 117 to normally engage arm 181 of pick up lever assembly 116 with spring anchor and stop post 178. The oppositely directed arm 182 of pick up lever assembly 116 is three times the length of short drive arm 181 to provide an approximately 3 to 1 ratio of movement between the free ends of arms 181 and 182 and is bent up at its free end to form a drive tooth 183 appropriately angled to drivingly cooperate with the teeth of circular rack 119 of the meter clock and flag unit 35 to be presently described.

Coin carrier bottom member 171 is provided with a second arm 185 (FIGS. **10*a* and 10*b*) angularly related to its spring anchor arm 174 and of substantial width thickened outwardly from its journal bore to its outer end (FIG. 10*b*) and provided at its outer end with pocket 55 opening outwardly through its outer edge and its free end to receive coins from coin slot 54** in member E.

The face of arm 190 of coin carrier top member 172 is recessed at 192 (FIG. **10*a*) to house the heads of securing screws 193 passing freely through screw openings (not shown) in arm 190 and threaded into suitably tapped screw openings (not shown) formed in the thickened portion of arm 185 of coin carrier bottom member 171 to fixedly join carrier bottom member 171 and coin carrier top member 172 for conjoint movement around their respective coaxial journal connections formed by the opposite ends of journal pin 112. Arm 190 of coin carrier top member 172 is provided with a laterally protruding stop extension 194 lying in a plane above the upper face of arm 190 as viewed in FIG. 3 and below the lower face of arm 190 as viewed in FIG. 10*b*, and which cooperated with a yielding stop ring 196 (FIG. 3) fixed to upstanding boss 187 having a tapped bore (not shown) by a securing screw 199. Arm 194 and stop 196 provides a homing stop for the coin drive mechanism D under the clockwise biasing effect of biasing spring 132 (FIGS. 2 and 3**).

As best shown in FIG. **10*b* pocket 55 is formed between the right ends of members 171 and 172. FIG. 10*c* shows the pocket forming portion of bottom member tioning coin drive mechanism D for time setting movement. At this time, stop extension 194 of coin drive mechanism D will be in its home position in engagement with stop 196. Upon initial manual clockwise rotation of knob 102 as viewed in FIG. 1, cam disk 107 and coin drive mechanism D will be rotated clockwise through shaft 31, stop extension 194 will leave stop ring 196 and lay in shutter 106 will be cammed in a clockwise direction around its pivot 111 through driving engagement of camming surface 127***a* of cam disk 107 with cam pin 127 of lay in shutter 106. Lay in shutter 106 is thus driven counterclockwise as seen in FIG. 2 around its pivot by disk 107 engaging pin 127 to bring shutter 126 into blocking position opposite the discharge ends of slot 54 as the coin carried by coin carrier and slot assembly 95 moves into juxtaposition to the entry end of coin cam C.

Further incremental time setting movement of coin drive mechanism D in a clockwise direction engages the inserted coin with radially opposed camming wall segment 62 or 66 camming coin carrier and slot assembly 95 counterclockwise around its pivot pin 112 fixed in hinge pillar assembly 108. This initial inward movement of coin carrier and slot assembly 95 is at least sufficient to assure that depressed section 204 of anti-backup pawl 61 passes off support surface 203 of member 172 into well 203 under influence of biasing spring 114 to engage its canted end 205 with ratchet teeth 59 of coin cam C. Once engaged, the canted end 205 of anti-backup pawl 61 remains yieldingly engaged until knob 102, shaft 31, and coin drive mechanism D travel full clockwise time setting are determined by engagement of stop finger 131 of cam disk 107 with upstanding stop abutment 301 formed on face F of casing 23 (FIG. 2).

Referring to FIGS. 3, 4, 5 and 10*b*, when a dime is inserted into slot 54 it is received in coin space 55*a* (FIGS. 5 and 10*b*) which is in radial alignment with walls 66, 68 and 70. The dime is supported in space 55*a* so that its outer periphery coincides with wall 70 so that during initial movement of the coin carrier wall 70 does not impart any camming action on the coin. As coin cycling movement of the coin carrier continues the dime is forced to ride up on cam wall 66 which causes carrier assembly 95 to rotate a small amount clockwise about its pivot pin 112. The amount of rotation imparted by cam wall 66 is sufficient to allow depressed portion 204 to drop into recess 201 under the influence of spring 114 (FIG. 6) causing the trailing edge of canted portion 205 of pawl 61 to engage teeth 59 thereby preventing return of the coin carrier to its home position until the full time setting stroke has been completed. However, due to the lost motion connection between push lever 121 and cam lever assembly 117 (post 178 received in slot 208), pick up lever 116 is not rotated into engagement with the teeth in rack plate 119 (FIG. 11) at this point. Upon continued movement of the coin carrying mechanism the dime is caused to ride up on cam wall 68 at which point the coin carrier 95 is caused to rotate further in a clockwise direction. At this point in the cycle since all of the lost motion between push lever 121 and lever assembly 117 is taken up, this further rotation of the coin carrier causes the lever assembly 117 and lever assembly 116 to rotate about pin 118 in a counterclockwise direction whereby drive tooth 183 engages one of the teeth on rack plate 119 and continued movement of the coin carrier and coin along wall 68 rotates rack plate 119 to actuate the time setting mechanism in the manner described in U.S. Pat. No. 3,506,102. The length of wall 68 is predetermined to rotate rack plate 119 an amount corresponding to the time purchased for a dime. When the coin reaches the end of wall 68 arm 215 contacts pin 218 (FIG. 3) to eject the coin and allow coin carrier 95 to rotate in a counterclockwise direction until stop arm 177 of cam assembly 117 (FIG. 7) abuts against projection 161 (FIGS. 8 and 9), and pin 178 (FIG. 9) engages the left end of slot 208 which causes the lever 116 to rotate in a clockwise direction to disengage rack plate 119. Also the counterclockwise rotation of coin carrier 95 causes depressed portion 204 of pawl 61 to ride up on bottom wall of member 172 (FIGS. 7 and 10*a*) to disengage the pawl 61 from teeth 59 and allow the entire coin cycling mechanism to return to its home position (FIG. 3) under the influence of spring 132.

When nickel is received in coin space 55*a*, before any movement of the coin carrier, it is in radial alignment with cam walls 66, 68 and 70. However the diameter of the nickel is such that when supported on the pin 209 as shown in FIG. 10*c* that topmost point on the periphery of the nickel is radially outward of walls 70 and coincides with the radial location of wall 72 which is aligned with and occupies generally the same plane as wall 62. Upon initial movement of the coin carrier 95 the edge of the nickel first contacts cam surface 74 (FIGS. 4 and 5) and upon further movement the nickel is canted inwardly against the bias of plate 220 to the point where its upper edge is aligned with walls 72 and 62. Upon further movement the edge of the nickel is caused to ride up on wall 62. The size of the nickel is such that riding up on wall 62 will cause rotation of the coin carrier 95 a sufficient amount to cause pawl 61 to engage teeth 59 but such rotation is insufficient to cause the lever arm 116 and tooth 183 to engage rack plate 119. Continued movement of the coin will therefore not cause any time to be registered on the meter indicator until the coin reaches and is caused to ride up on wall 64. At this point the coin carrier 95 is caused to rotate a sufficient amount to cause tooth 183 of lever 116 to engage rack plate 119. The length of wall 64 is such that continued movement of the coin and coin carrier to the end of wall 64 will rotate the rack plate an amount to cause time corresponding to a nickel to be registered on the meter indicator. When the end of wall 64 is reached the coin is ejected, tooth 183 is disengaged from rack plate 119, pawl 61 is disengaged from teeth 59 and the coin cycling mechanism will be returned to its home position in the manner described in connection with operation with a dime described above.

When a quarter is received in coin space 55*a* as in the case of a nickel and dime, before any initial movement of the mechanism the coin is in alignment with walls 70 and 66. However the diameter of the quarter is such that when supported in the space 55*a* as shown in FIG. 10*c* the outermost point on its periphery extends radially outwardly both wall 72 and wall 62. Upon initial movement of the coin carrier, as in the case with a nickel the quarter is canted inwardly by cam surface 74 so that its edge is aligned with and contacts wall 72 which causes sufficient rotation of the coin carrier 95 about its pivot pin 112 to depress pawl 61 into a position to contact teeth 59, but will not cause sufficient rotation of the coin carrier about pins 112 to engage tooth 183 with rack plate 119. Further movement of the coin carrier causes the quarter to ride up on wall 62 which causes sufficient rotation of the coin carrier to engage tooth 183 with rack plate 119 and thereby actuate the time setting mechanism. As the coin is moved along wall 62 it will approach and ride up on wall 64 which will cause further clockwise rotation of carrier 59 about pins 112. However because of the lost motion connection between push lever 121 and cam lever 117 and the resiliency of spring 116 this further rotation of the carrier 95 about its pins 112 is accommodated without affecting the engagement of tooth 183 with rack plate 119. Thus the rack plate 119 will be engaged by tooth 183 as the quarter moved along the entire lengths of both wall 62 and 64 to cause time to be registered on the indicator corresponding to a quarter. When the quarter reaches the end of wall 64 it is ejected and coin handling mechanism is returned to its home position in the same manner as described above in connection with a dime.

It will be understood that other combinations of coins such as penny-nickel-dime may be used within the purview of the instant invention. In such a case the dime would cooperate with walls similar to wall 66 and the nickel and penny with walls similar to 62 and 64. It will also be understood that the position of the coins in the coin space 55*a*, the radial position and the length of the various walls would be adjusted to insure adequate initial rotational movement of the coin carrier 95 to engage the antibackup pawl 61, to insure engagement of the rack plate 119 by tooth 183 and to register time proportional to the value of the coins being cycled.

The invention herein described therefore provides an improvement over the prior art as exemplified in U.S. Pat. No. 3,506,102 in that means are provided within the meter to align the coin with the appropriate cam wall in accordance with coin value whereby only a single coin entrance slot need be provided, thus preventing coin from being inserted into the wrong entrance slot and the consequent loss of the coin without registration of time.

I claim:

1. In a time setting mechanism for setting time in accordance with the denomination of coin inserted therein, a housing, a coin opening in said housing for inserting a coin into said mechanism, coin carrying means having a receptacle for receiving a coin inserted into said meter mechanism and movable from an initial postion for receiving a coin into said receptacle through a time setting cycle, a plurality of parallel time-setting cam surfaces associated with said coin carrier extending adjacent to the path of movement of a coin in said coin carrier, at least two of said cam surfaces being displaced from each other in a direction perpendicular to the direction of movement of said coin carrying means, additional unitary fixed cam means within said housing responsive to the size of said coin to align said coin with a selected one of said time setting cam surfaces.

2. The mechanism of claim 1 in which said additional cam means is operative upon initial movement of said coin carrying means.

3. The mechanism of claim 1 in which said additional unitary fixed cam means bridges said two cam surfaces.

4. The mechanism of claim 2 in which said additional cam means cooperates with said coins of a predetermined size to move said coins in a direction perpendicular to the direction of movement of said coin carrying means to move said coin into alignment with said selected one of said time setting cam surfaces.

5. The mechanism of claim 4 in which the movement of said coin in said direction perpendicular to the direction of movement of said coin carrying means is resisted by a resiliently biased member.

6. In a time setting mechanism for setting time in accordance with the denomination of a coin inserted therein, a housing, a coin opening in said housing for inserting a coin into said mechanism, coin carrying means having a receptacle for receiving a coin inserted into said meter mechanism and movable from an initial position through a time setting cycle, cam means associated with said coin carrier having a plurality time setting cam surfaces extending adjacent to the path of movement of a coin in said coin carrier when said coin carrier is moved through said time setting cycle, each of said time setting cam surfaces occupying planes perpendicular to the direction of movement of said carrier different from the plane occupied by another of said time setting cam surfaces, means carried by said receptacle to resiliently bias said coin into alignment with one of said time setting cam surfaces when said coin carrier is in said initial position, cam means to move said coin against the bias of said last mentioned means to align said coin with another of said time setting cam surfaces upon initial movement of said coin carrier away from said initial position.

7. In a time setting mechanism for setting time in accordance with the denomination of coin inserted therein, a housing a coin opening in said housing for inserting a coin into said meter mechanism, coin carrying means having a receptacle for receiving a coin into said mechanism and movable from a home position through a time setting stroke, a cam member having a plurality of arcuate concentric time setting cam surfaces extending adjacent and parallel to the path of movement of a coin in said coin carrying means when said coin carrying means is moved from said home position through said time setting stroke, at least two of said time setting cam surfaces being displaced from each other in a direction perpendicular to the direction of movement of said coin carrying means, said receptacle comprising a resiliently biased member to form a coin receiving space in said receptacle, said coin receiving space being aligned with one of said time setting cam surfaces, additional cam means cooperating with a coin of a given size to move said coin into alignment with another of said time setting coin surfaces upon initial movement of said coin carrying means.

8. The mechanism of claim 7 in which at least two of said plurality of arcuate time setting cam surfaces are co-planar with each other but of a different radial distance from the axis of curvature of said coin surfaces.

9. In a time setting mechanism for setting time in accordance with the value of coins of at least two different sizes, a single entry coin opening in said housing for inserting a coin into said mechanism, coin carrying means having a receptacle for receiving a coin inserted into said meter mechanism and movable from an initial position for receiving a coin into said receptacle through a time setting cycle, a plurality of parallel time-setting cam surfaces associated with said coin carrier extending adjacent to the path of movement of a coin in said coin carrier, at least two of said cam surfaces being displaced from each other in a direction perpendicular to the direction of movement of said coin carrying means, said coin being initially aligned with one of said cam surfaces, means within said housing responsive to the larger of said coins to move said coin into alignment with another of said time setting cam surfaces.

10. The mechanism of claim 1 in which said responsive means is operative upon movement of said coin carrying means away from said initial position.

11. The mechanisms of claim 10 in which said responsive means comprises additional cam means which cooperates with coins of a predetermined size to sense the size thereof.

12. The mechanism of claim 9 in which said last mentioned means is a cam bridging said two cam surfaces.

* * * * *

UNITED STATES PATENT OFFICE

CERTIFICATE OF CORRECTION

PATENT NO. : 3,970,182

DATED : July 20, 1976

INVENTOR(S) : William C. Kiehl, Thomas F. Moore, Jimmie C. Teague

It is certified that error appears in the above-identified patent and that said Letters Patent are hereby corrected as shown below:

Column 2, Line 41, following "23" insert --removably--.

Column 4, Line 68, following "its" insert --home--.

Column 6, Line 36, change "35" to --36--.

Signed and Sealed this

Second Day of November 1976

[SEAL]

*Attest:*

RUTH C. MASON
*Attesting Officer*

C. MARSHALL DANN
*Commissioner of Patents and Trademarks*